US005182241A

United States Patent [19]

Kistrup et al.

[11] Patent Number: 5,182,241

[45] Date of Patent: Jan. 26, 1993

[54] TREATING ACCUMULATED WASTE WATER FROM PLASTIC SUBSTRATES ACTIVATED WITH PD/SN SOLUTIONS

[75] Inventors: Holger Kistrup, Esslingen; Otwin Imhof, Nürtingen, both of Fed. Rep. of Germany

[73] Assignee: Deutsche Automobilgesellschaft mbH, Fed. Rep. of Germany

[21] Appl. No.: 780,113

[22] Filed: Oct. 21, 1991

[30] Foreign Application Priority Data

Oct. 22, 1990 [DE] Fed. Rep. of Germany ..... 4033518

[51] Int. Cl.[5] ..... B01J 38/68; C23C 16/00; B05D 3/04; C25D 5/54

[52] U.S. Cl. ..... 502/24; 106/1.11; 427/306

[58] Field of Search ..... 502/25, 22; 106/1.11; 427/306

[56] References Cited

U.S. PATENT DOCUMENTS

| | | | |
|---|---|---|---|
| 4,120,822 | 10/1978 | Jameson | 106/1.11 |
| 4,717,421 | 1/1988 | Frisby et al. | 106/1.11 |
| 4,933,010 | 6/1990 | Okabayashi et al. | 106/1.11 |
| 5,089,301 | 2/1992 | Kistrup et al. | 427/306 |

*Primary Examiner*—Paul E. Konopka

*Attorney, Agent, or Firm*—Evenson, Wands, Edwards, Lenahan & McKeown

[57] ABSTRACT

A process treats the waste water which accumulates as used activation solution in the one-step activation, on the basis of acidic palladium/tin solutions, of large-surface plastic substrates, in particular of non-woven fabric, needled felt or open-pored foam sheets, for the purpose of a subsequent chemical metallization. A concentrate composed of palladium chloride and sodium chloride and then a solid tin salt in a molar ratio of 1:1.5 to 1:4, based on the palladium, is added to the waste water. After a certain maturing time, a ready-to-use activation solution is again obtained for activating a plastic substrate and reduces the amount of the waste water hitherto accumulating after the activation has taken place.

3 Claims, No Drawings

TREATING ACCUMULATED WASTE WATER FROM PLASTIC SUBSTRATES ACTIVATED WITH PD/SN SOLUTIONS

BACKGROUND AND SUMMARY OF THE INVENTION

The present invention relates to a process for treating the waste water produced in a one-step activation of plastic substrate sheets, which waste water accumulates as used activation solution after activation has taken place, and, more particularly, to a process using palladium/tin solution for large surface substrates, in particular of non-woven fabric, needled felt or open-pored foam sheets in which the solutions are to be reused.

Chemical metallization of plastic sheets, for example, sheets composed of non-woven fabric, needled felt or open-pored foams, is presently carried out on a large scale. Such sheets of textile material are, among other things, inexpensive to manufacture and readily variable in relation to their thickness and porosity. As a result of applying a metal layer to the surface of the sheets, additional favorable properties such as, for example, electrical conductivity, magnetic and thermal conduction properties are achieved in these products. To metallize the plastic surfaces, however, they first have to be prepared for a metal deposition. In many cases, the plastic surfaces are first pretreated mechanically (e.g., roughening) or chemically (e.g., etching).

Since the plastic fibers processed to produce the sheets mentioned are electrically insulating and are consequently unsuitable for a direct chemical metal deposition, they first have to be "activated" beforehand, i.e. catalytically active particles containing noble metal have to be deposited on the plastic surface. These particles, which have to be deposited on the plastic surface with as firm adhesion as possible, serve to catalyze the subsequent actual metal deposition by chemical processing from a metastable solution. The preferred catalyst solutions are produced on the basis of Pd/Sn; however, other compounds containing noble metal are in principle also suitable provided only that they are suitable for getting under way the kinetically inhibited chemical reduction of dissolved metal ions by a reducing agent, also present in the solution, on the plastic surface.

If the plastic surface has been suitably pretreated and activated, chemical metallization is carried out after, if necessary, intermediate steps which also have to be carried out such as hydrolysis or acceleration. The metals mainly deposited on an industrial scale on plastic surfaces are copper and nickel. Formaldehyde tends to be used as the reducing agent for the deposition of copper, and borohydrides or hypophosphite as agents for the deposition of nickel. After an initial chemical metal deposition, the metal coating can be reinforced as desired, for example, by electrodeposition, in which process the metal already deposited on the plastic surface or even another metal (for example, chromium or certain metal alloys) may be deposited. A review of the prior art in relation to the pretreatment, the activation and the chemical metallization of plastic substrates is comprehensively described in "Kunstsoff-Falvanisierung" ("Electroplating of Plastics") (E. Lenze Verlag, Saulgau).

In the activation of plastic substrates on the basis of Pd/Sn, a distinction is always made between a one-step and a two-step activation. The process involved here relates exclusively to the one-step activation of plastic substrates. This procedure employs activation solutions which have a high concentration of Pd/Sn. If plastic parts whose surfaces are flat and not very porous are activated with them, in all cases only a small amount of palladium based on the total palladium content, is removed from the activation bath. Consequently, the activation solution can be repeatedly used for very many activation operations and for a long period of time. This reuse of the activation solution is based on the fact that such activation solutions are rendered durable as a result of a high tin excess and a considerable addition of acid and as a result of the addition of further substances having a stabilizing action on the palladium sol. This means that, in the course of the use of the activation bath, an excess of complexly dissolved or colloidally dispersed, catalytically active palladium particles is in total always held in solution, and only a small part thereof is deposited in all cases on the activated plastic surface and consequently removed from the activation solution.

If, however, large-surface plastic products such as non-woven fabrics, needled felt or open-pored foams are to be activated by a one-step activation on the basis of palladium/tin, other requirements have to be imposed on the activation solution used. When such a plastic sheet is pulled through the activation solution, an appreciable part of the solution remains in the pores of the sheet. Before the subsequent step of the chemical metallization, the solution has to be removed from the pores of the sheet so that appreciable amounts of used activation solution accumulate as waste water which is not the case in the activation of flat plastic surfaces. An added complication is that the fiber surfaces or the pore walls of the sheets are provided with an anti-statically acting fiber finish as a result of processing and these anti-static agents have a precipitating, i.e. destabilizing, action on the palladium sols. This is all the more so, as the molar excess of tin become smaller, based on the palladium present in the activation solution, and as the acid content of the solution becomes smaller. In appearance, such a destabilized Pd/Sn-containing activation solution, which has consequently become unusable, can be recognized by the fact that the solution is turbid and contains flakes of precipitate which segregate in the sheet pores.

In order to reduce the amounts of waste water accumulating in the activation of plastic sheets, it has already been proposed to omit certain pretreatment steps before the activation. This is possible if the plastic surface has only a hydrophilic finish or if no particularly high requirements are imposed on the adhesion of the subsequent metal coating to the plastic surface. After activation of large-surface plastic sheets has taken place, used activation might be removable in a mechanical way from the pores of the sheets and accumulatable as waste water. In this connection, see German Patent No. 3,637,130, German Patent No. 3,631,055 and German Patent No. 3,837,835. The amount of waste water accumulating at least per activation operation is in that case approximately equivalent to the free pore volume of the sheet fed through the activation solution. This waste water can as a rule only be supplied for a fresh use after complicated waste disposal, i.e. after removal of palladium and tin, hydrochloric acid and fiber finish.

U.S. Pat. No. 4,600,699 discloses a process is already known in the case of activation solutions for treating the used solutions and the accumulating rinse water, and for regenerating them to produce a fresh ready-to-use activation solution. For this purpose, the component of the active substances left in the solutions is precipitated and is redissolved in substantially smaller amounts of water. The amount of solution accumulating during the activation is reduced by producing harmless waste water.

In order to simplify the waste disposal, German Patent Specification 3,843,903 has already proposed an activation solution on the basis of complexly dissolved palladium/tin which can be prepared rapidly and simply and in which case the used activation solution should be polluted with as small amounts as possible of noxious substances to be disposed of.

An object of the present invention is, therefore, to treat the used activation solution accumulating after activation has taken place in a one-step activation, on the basis of palladium/tin, of large-surface plastic substrates, in particular of non-woven fabric, needled felt or open-pored foam sheets, to again produce a fresh ready-to-use activation solution. At the same time, this reduces the amount of waste water accumulating after activation has taken place is reduced, based on an activation operation or a specified activated amount of sheet.

This object has been achieved according to the present invention by adding a concentrate of palladium (II) chloride and sodium chloride to the used activation solution at room temperature while stirring vigorously. A solid tin (II) salt is then added to this mixture in a molar excess of 1:1.5 to 1:4, based on the palladium, again while stirring vigorously, and allowing the solution enriched in palladium (II) and tin (II) ions to stand for at least 10 minutes for the purpose of maturing and being reused as a fresh solution.

Surprisingly, it has been found that the waste water removed from the pores of the plastic substrate sheet after activation has occurred and composed of used activation solution can easily be treated to produce a fresh mixture of an activation solution and can be reused for further activation. In this connection it is important that the palladium is added to the waste water not, as is usual, in a solution containing hydrochloric acid, but in the form of a neutral concentrate, after which a solid tin (II) salt is then added to the mixture in a molar ration of 1:1.5 to 1:4, based on the palladium.

Surprisingly, it has been found that the fiber finish dissolved in the waste water and also the residues of the flocculated palladium sol from the preceding activation do not have a flocculating action on adding the concentrate and the solid salt. A maturing time of 10 to 40 minutes after adding the two constituents before the catalytically particularly effective dark-brown complexes of the zero-valency palladium had formed was also not substantially prolonged.

DETAILED DESCRIPTION OF THE INVENTION

In practice, the procedure according to the present invention is that an activation solution containing hydrochloric acid, and palladium and tin in a molar ratio of 1:1.5 to 1:4, based on the palladium, is used in the matured state to activate a plastic substrate sheet. After the used activation solution has been removed mechanically, for example, by spinning off or pressing off from the pores of the sheet, this waste water is allowed to stand for a certain time. Then the liquid concentrate of a pH-neutral palladium salt is added. Preferably this is an equilibrium mixture of palladium (II) chloride and sodium chloride to which water is added until a viscous, clear solution has formed. The solid tin (II) salt is added to this mixture while stirring in a molar excess of 1:1.5 to 1:4, based on the palladium. The fresh activation solution thus obtained is allowed to mature for between 10 to 30 minutes in order to then use it to activate a further plastic substrate sheet.

The advantages of the process according to the present invention are, in particular, that the amount of the used activation solution hitherto accumulating in the activation of plastic substrate sheets is appreciably reduced since the accumulated waste water removed from the pores of the sheet is treated to produce a fresh activation solution. On twice treating the waste water from the first activation operation and reusing it for two activation operations, the amount of waste water decreases to a third, based on the three activation operations. In practice, it has been found that even a five-fold reuse of the waste water retreated in each case from the first activation is possible. The plastic substrate sheets treated therewith were all of good quality and uniformly activated.

By way of specific example, a needled felt sheet composed of polypropylene fibers was treated with an activation solution containing noble metal and based on palladium/tin. The nominal thickness of the needled felt sheet was 2.5 mm, the porosity of the sheet was 93% and the fibers had a thickness of 20 $\mu_p$m. A solution containing hydrochloric acid (about 3% by weight of hydrochloric acid) and having a content of approximately 100 mg of $PdCl_2$/1 was prepared as the activation solution. Solid tin [II) chlorodihydrate was added to this solution while stirring in a molar ratio of Pd/Sn=1:3. After about 30 minutes, it was possible to use the clear and dark-brown solution for impregnating the needled felt sheet. The needled felt sheet was left in contact with the activation solution for about ½ hour and then the used activation solution was mechanically removed from the pores of the sheet by spinning. The waste water so obtained was treated to produce a fresh mixture of an activation solution. For this purpose, a concentrate was prepared from an equilibrium amount of palladium chloride and common salt (1 g of $PdCl_2$ and 1 g of NaCl) and a small amount of water. The concentrate had a pH of 7. Enough of this concentrate was added, while stirring, to the waste water for the content to again be about 100 mg of palladium chloride per 1 (one) l of waste water. Then a three-fold molar excess, based on the palladium, of solid tin (II) chlorodihydrate was added to this mixture also, again while stirring vigorously. After about 20 minutes, the activation solution freshly prepared from the waste water of the first activation had matured and a second needled felt sheet was activated with it as specified above. After the activation operation had taken place, the waste water was again spun off, again treated in the way described above and reused for a further activation of a needled felt sheet. The Pd/Sn catalyst particles had been deposited uniformly on all three consecutively-activated needled felt sheets. It was possible to establish this qualitatively by assessing the chemical metallization subsequent to the activation of the sheets and the reinforcement by electrodeposition. The amount of waste water accumulating in the activation of the three sheets had been reduced to one third.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A process for treating waste water which accumulates as used activation solution after activation has taken place in a one-step activation, on the basis of palladium/tin solutions, of large-surface plastic substrates for a subsequent chemical metallization in order to reuse said solutions as ready-to-use activation solutions, comprising the steps of adding a concentrate of palladium chloride an sodium chloride to the used activation solution at room temperature while stirring vigorously to form a mixture, then adding a solid tin salt to the mixture in a molar excess of 1:1.5 to 1:4, based on the palladium, while stirring vigorously to produce a solution enriched in palladium and tin ions, and then allowing the solution enriched in palladium and tin ions to stand for at least 10 minutes for maturation and use as a fresh, ready-to-use activation solution.

2. The process according to claim 1, wherein the substrates comprise non-woven fabric, needled felt and open-pored foam sheets.

3. The process according to claim 1, wherein the step of adding comprises adding an equilibrium concentrate of palladium chloride and sodium chloride having a pH of 7 to the used activation solution to be treated.

* * * * *